United States Patent [19]

Lindström et al.

[11] 4,316,331

[45] Feb. 23, 1982

[54] METHODS FOR MECHANICALLY DEWATERING PEAT

[76] Inventors: Olle B. Lindström, Lorensviksvagen 14, 18363 Taby; Rikard O. Lindström, Rosenlundsgatan 28 A, 11653 Stockholm, both of Sweden

[21] Appl. No.: 962,710

[22] Filed: Nov. 21, 1978

[30] Foreign Application Priority Data

Nov. 29, 1977 [SE] Sweden ..... 7713395

[51] Int. Cl.[3] ..... F26B 7/00; F26B 5/08

[52] U.S. Cl. ..... 34/17; 34/18; 44/12; 159/47 R; 210/781

[58] Field of Search ..... 44/29, 12, 33; 34/8, 34/17, 58, 60, 19; 210/78, 781; 159/47 R

[56] References Cited

U.S. PATENT DOCUMENTS 962,119 6/1910 Bradley ..... 44/33

FOREIGN PATENT DOCUMENTS 370929 4/1932 United Kingdom .

1259844 1/1972 United Kingdom .

*Primary Examiner*—John J. Camby

*Attorney, Agent, or Firm*—Burns, Doane, Swecker & Mathis

[57] ABSTRACT

Wet peat is dewatered mechanically by conditioning a peat slurry in a decanter centrifuge producing an effluent containing peat particles, and a peat sludge. The sludge thereafter is subjected to a mechanical pressing operation.

4 Claims, 3 Drawing Figures

METHODS FOR MECHANICALLY DEWATERING PEAT

BACKGROUND AND OBJECTS OF THE INVENTION

The present invention relates to the dewatering of peat. The global reserves of peat represent very large quantities of energy. Peat is furthermore a fuel which is environmentally acceptable due to its low sulphur content and low content of ash. In spite of this, peat has not become a major source of fuel except during periods of crises and blockade. This is due to the fact that peat always contains large quantities of water. Solving the dewatering problem has therefore always received much effort in countries with large peat reserves. If it would be possible to economically dewater peat in a mechanical way, peat could be made available for energy production at very low cost and at a very small environmental impact.

The present invention involves a new method to dewater peat mechanically which seems to meet all that could be desired in this connection. The method not only permits economical mechanical dewatering with all the advantages connected with such expedient but also imparts to the peat a suitable consistency for further treatment in the processes of pyrolysis, gasification and hydrogenation.

Many different methods have been proposed for mechanical dewatering of peat. A summary of these methods is presented e.g., in a book "Torv i Sverige" (Peat in Sweden), Stockholm 1977. The prior inventors have tried numerous dewatering techniques, such as chemical methods involving the addition of coagulating electrolytes, as well as thermal methods for more radical changing of the peat structure, so-called wet carbonization, "Vatkolning a torv" (Wet carbonization of peat) 1960, AB Svensk Torvforadling. Several of these methods have been successful from a technical point of view, e.g., the method of wet carbonization mentioned above, but has still not come into general use due to high cost and environmental problems associated with the discharges of waste water from the process.

Evidently, the final step in a process for mechanical dewatering of peat should comprise a pressing step. The various methods have therefore been concerned with the task of conditioning the peat so as to facilitate the pressing operation and render it economical.

BRIEF SUMMARY OF THE INVENTION

It has also recently been proposed to pre-treat peat in a ballmill so as to facilitate dewatering by pressing, centrifugation and similar operations. The present invention belongs to this category of processes but differs radically from the methods mentioned above. The significant feature of the process according to the invention is that the peat slurry is first treated in a decanter centrifuge, with discharge of the effluent, whereafter the product flow from the decanter centrifuge (the peat slurry or sludge), is dewatered in a mechanical pressing means such as a band press, screw press, sheet press or similar device.

The invention thus comprises a combination of two operations known per se, i.e., decanter centrifugation and pressing which have produced surprisingly successful results.

The technical explanation for the success of the method is not completely understood. It seems probable to be a combination of a certain discharge of a fraction of fine particles, termed fine fraction, and a certain mechanical treatment of the peat material in the decanter centrifuge. It should be pointed out the surprising fact that the pre-dewatering (which occurs in the decanter centrifuge) seems also in itself to improve the dewatering properties of the peat. The technical effect of the invention thus probably depends on a number of cooperating and independent factors which result from the combination of decanter centrifugation and pressing steps according to the invention.

THE DRAWING

The principle of the invention shall be described by means of

FIG. 1 which depicts schematically the sequence of steps to be performed on the peat.

DETAILED DESCRIPTION OF PREFERRED EMBODIMENTS OF THE INVENTION

Figure 1:
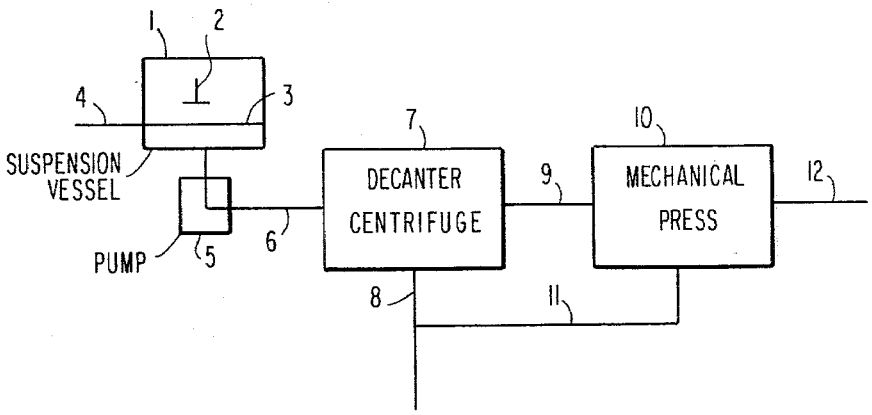

In accordance with the invention peat is mined in the known manner, e.g., by means of an excavator and dumpers, or by the hydro-peat method.

The recovered peat is dissolved to a suspension in a vessel 1 with the aid of a stirrer 2 or other similar known means. Stumps, stones, etc. are separated by the separating means 3 comprising a rotating perforated drum or similar known means. If desired the dissolving and separating operations can be carried out in the same apparatus. Separated stumps and stones are discharged through an outlet 4. The peat suspension thus obtained, which may have a content of dry matter between 0.5–15%, preferably 3–5% dry matter, is pumped by a pump 5 through the pipe 6 to a decanter centrifuge 7. The fine fraction leaves the centrifuge 7 via a pipe 8 as so-called effluent. The effluent may contain 5–60% of the dry substance originally present in the feed, preferably 10–30% dry substance, depending on the particle size distribution of the raw material and other factors. Peat with a low degree of humification, suitable for agricultural purposes, may leave less than 5% dry substance in the effluent, frequently 2–5%. The fine fraction may then be treated in several different ways, e.g., by flocculation and sedimentation of a peat bog. The clear supernatant water from the effluent may be used for the preparation of the feed peat suspension.

The pre-dewatered product flow of peat slurry which may contain up to 15–35% by weight dry substance, preferably 10–25% dry substance, is transported by a transfer system 9 which may be a known transportation system, e.g., transport band or screw feeder, to a press 10. The press can be of the types mentioned earlier, preferably an Ecobelt ® or Multibeltpress ®. The press water exits via a pipe 11. The effluent water from the press is preferably conducted to the pipe 8 and mixed with the effluent from the centrifuge. The pressed product, in cake-like form, is discharged from the press 10 by a discharging mechanism 12.

Water leaves very easily during the pressing compared to pressing of peat treated in the previously known manner. The rate of production of fuel peat therefore becomes very high compared to the state of art and a very high content of dry matter may be obtained, e.g., 40–65% dry substance, at low pressing costs.

PREFERRED CENTRIFUGE

Figure 2:
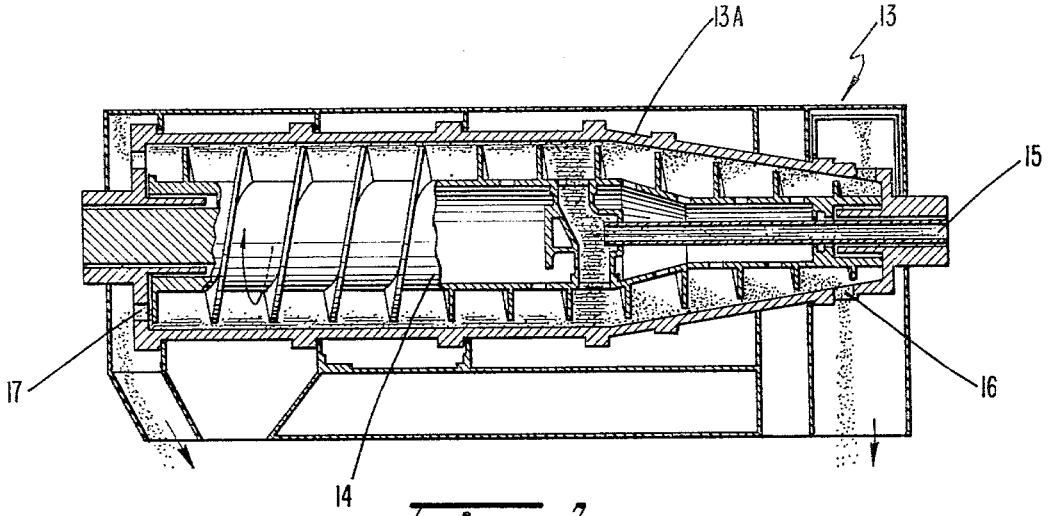
FIG. 2 depicts a conventional decanter centrifuge.

There are many different types of apparatus on the market which are suitable for the procedure according to the invention. Decanter centrifuges suitable for the procedure according to the invention are, for example, manufactured by the company Alfa-Laval of Tumba, Sweden. Such a decanter centrifuge is described in Brochure No. PB 40225S2 of that company, the subject matter of which is hereby incorporated by reference as if set forth at length herein. As is shown in this brochure, and in FIG. 2, a decanter centrifuge 13 comprises a rotating cylinder 13A with an internal screw 14.

The cylinder and screw are rotated at high speeds. Material to be treated is fed into the machine via a central inlet pipe 15. Rotational forces act upon the material, forcing it towards the periphery of the cylinder. Peat particles are caused to separate-out against the cylinder into a sediment by the centrifugal forces established. The screw 14 moves the sludge resultant toward an outlet 16. The sludge is dewatered above the water level in a narrower section of the centrifuge. Particles which have not had time to separate-out leave with the discharged water as so-called effluent through another outlet 17.

Preferred Press

Figure 3:
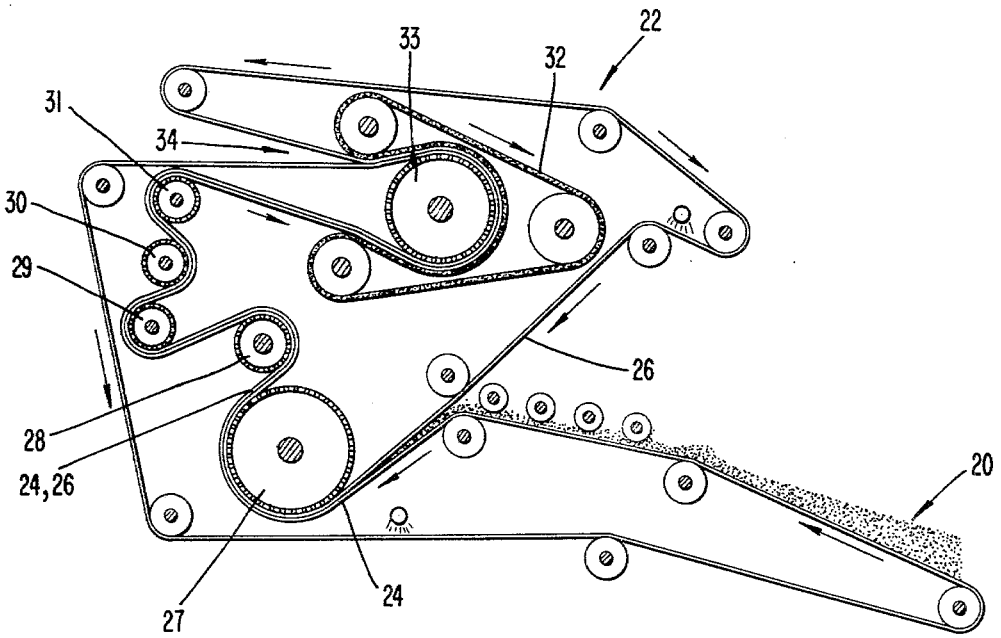
FIG. 3 depicts a conventional band press.

The second important component for the procedure according to the invention is the mechanical pressing means. Presses are used in different technical operations and many of these presses are suitable for the procedure according to the invention. Quite generally it may be stated that many different parameters influence the result of the pressing operation, e.g., the thickness of the press layer, the press pressure, the pressing time, the means for discharge of water, the temperature, etc. When dewatering peat it is particularly suitable to work with comparatively thin press layers up to a few cm. The invention can, however, also be supplied for thicker pressing layers, e.g., in sheet presses. The following press construction has proven to be particularly useful for the procedure according to the invention. The Ecobelt ® press or the Multibeltpress ® is a band press developed for cellulose and dewatering of sewage sludge. The new feature of interest is a production of high pressure, e.g., a pressure of around 2 MPa. The company Alfa-Laval describes this press in its Brochure No. PC 40558 E, the subject matter of which is hereby incorporated by reference as if set forth at length herein. As depicted in FIG. 3, material 20 to be treated in the band press 22 is fed into the nip betwen a pair of filter bands 24, 26. Those filter bands travel around a series of perforated rollers 27, 28, 29, 30, 31 which progressively decrease in diameter, thereby causing the pressure on the material to increase successively. Thereafter, the material passes to a high pressure stage, where an additional belt 32 presses the filter belts 24, 26 against a perforated roller 33. The dewatered material is discharged at 34. The Axel Johnson Institute describes the press in a brochure given out by the institute, entitled Multibelt Sludge Dewatering Press, the subject matter of which is incorporated by reference as if set forth at length herein.

The screw press is another known and suitable press construction. The screw pushes the peat material within a conical container whereby the peat material becomes compacted.

Many other known presses may be used, e.g., roller presses, bark presses, etc. A compilation is found in a report from the Department of Chemical Technology at the Royal Institute of Technology, i.e., the Spring 1976 "Technical-Economic Comparison Between Different Methods For Peat Dewatering".

EXAMPLE

The invention shall now be described in more detail by means of the following example.

In this test a Sphagnum peat moss with a degree of humification according to the von Post's scale H 6–8 was used. The peat contained about 10% dry substance.

The peat was dissolved in a vessel with a vibrator stirrer during water addition until the slurry contained 3% dry substance. A slurry was then fed at a rate of 2.6 $cm^3$ slurry/hr to an ALFA LAVAL decanter centrifuge.

The maximum capacity of the decanter centrifuge was 6 $m^3$/hr. The decanter was adjusted so that 20% of ingoing dry matter left with the effluent and the residue was discharged by the screw in the form of pre-dewatered sludge with 24% dry substance.

During subsequent pressing of the peat on a type of sheet press with thin press layers, more than 2000 kg of dry substance was obtained per $m^2$ of press area and per each hour of peat with 40% by weight dry substance; also 500 kg of dry substance/$m^2$/hour of peat with 50% dry substance were produced at an increased pressing time. The applied pressure was 10–20 kp/$cm^2$.

For comparison can be mentioned that the pressing of raw peat gave less than 10 kg dry substance/$m^2$/hour of peat with 40% dry substance. If the peat is pre-dewatered by filtration to 18% dry substance, then about 70 kg dry substance/$m^2$/hour is produced of peat with 40% dry substance. If mainly the finer particles are removed from the peat amounting to 10–20% of its total content of dry matter, then about 70 kg dry substance/$m^2$/hour of peat with 40% dry substance is obtained. A combination of these two treatments should thus at best given an additive effect, i.e., about 140 kg of dry substance/$m^2$/hour of peat with 40% dry substance.

Quite surprisingly, it has been found that by means of the present invention there is produced more than 10 times the amount of peat with 40–65% dry substance from a press when the peat has been treated in a decanter centrifuge.

The expert will experience no difficulty in the application of the invention with other known apparatus for decanter centrifugation and other known pressing means.

It has been found that the invention gives the same surprising effect with all sorts of peat species. On the contrary such effect is not obtained if suspensions of biomass such as algae from sea born energy plantations or suspensions of wood powder from soilborn energy plantations are treated instead of the peat.

Thus, according to the present invention, peat which is treated in a decanter centrifuge becomes, in effect, conditioned for a much more efficient dewatering in a press. Accordingly, the dewatering of peat becomes more economically feasible.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A process for dewatering peat, said process utilizing a decanter centrifuge and a mechanical press, said process comprising the steps of:

subjecting a slurry of water and fibrous peat to centrifugal forces in the decanter centrifuge to separate from said water/peat slurry an effluent of water and fine peat particles, recovering said water/peat slurry absent said separated effluent, and thereafter mechanically pressing the recovered water/peat slurry in the press to express water from the recovered water/peat slurry, at least a substantial portion of which water being expressed in liquid form.

2. A process according to claim 1, wherein said recovered water/peat slurry is mechanically pressed until the slurry contains from 40–65% dry substance by weight.

3. A process according to claim 1, wherein said fine peat particles contained in said effluent constitute at least 10% by weight of the dry substance originally present in the slurry.

4. A process according to claim 1, wherein said recovered water/peat slurry contains from 10% to 35% dry substance by weight.

* * * * *